US006771363B1

(12) United States Patent
Van Den Berg

(10) Patent No.: US 6,771,363 B1
(45) Date of Patent: Aug. 3, 2004

(54) DEVICE AND METHOD FOR DETERMINING A BENDING ANGLE OF A SHEET AND THE USE THEREOF FOR THE ANGLE-BENDING OF SHEETS

(75) Inventor: Max Van Den Berg, Woerden (NL)

(73) Assignee: Best Quality B.V., Woerden (NL)

( * ) Notice: Subject to any disclaimer, the term of this patent is extended or adjusted under 35 U.S.C. 154(b) by 0 days.

(21) Appl. No.: 10/111,188

(22) PCT Filed: Oct. 20, 2000

(86) PCT No.: PCT/NL00/00761

§ 371 (c)(1),
(2), (4) Date: Aug. 21, 2002

(87) PCT Pub. No.: WO01/28706

PCT Pub. Date: Apr. 26, 2001

(30) Foreign Application Priority Data

Oct. 22, 1999 (NL) ..... 1013378

(51) Int. Cl.[7] ..... G01B 11/26; B21B 37/00; B21C 51/00

(52) U.S. Cl. ..... 356/152.1; 72/11.1; 72/37

(58) Field of Search ..... 356/152.1, 139.03; 72/11.1, 37

(56) References Cited

U.S. PATENT DOCUMENTS 4,564,765 A * 1/1986 Blaich
5,148,693 A 9/1992 Sartorio et al.
5,329,597 A * 7/1994 Kouno et al.
5,367,902 A * 11/1994 Kitabayashi et al. ..... 72/37
5,488,470 A * 1/1996 Ooenoki

FOREIGN PATENT DOCUMENTS

DE 43 12 565 A 10/1994
EP 0 166 351 A 1/1986
NL 9 301 528 A 11/1983

* cited by examiner

*Primary Examiner*—Stephen C. Buczinski
(74) *Attorney, Agent, or Firm*—Young & Thompson

(57) ABSTRACT

A method for determining the bending angle of a sheet which has been bent along a bending line, by generating at least one light beam, using these beams to project two points or line segments onto a part of the sheet to be checked which lies on one side of the bending line. The beams form an angle of incidence which is known in advance with the bending line of the sheet. These points or line segments are imaged onto receiving means and the distance between the points or line segments is determined, which have been projected onto the receiving means. The beams lie in two parallel detection planes, the distance between which is known. The bending angle is determined from the distance between the projected points, the known angles of incidence of the beams and the known distance between the detection planes.

15 Claims, 2 Drawing Sheets

Figure 1:
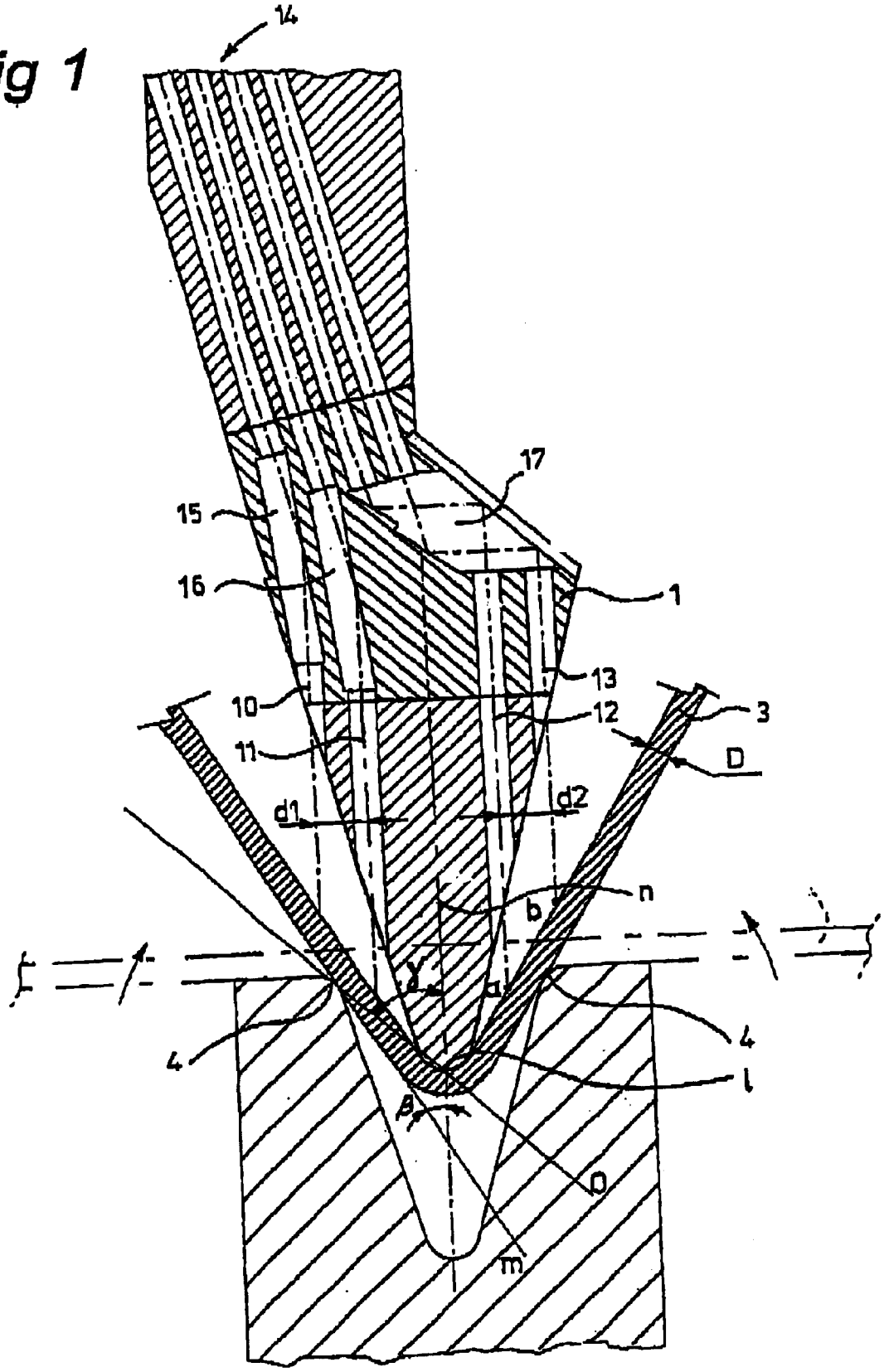

DEVICE AND METHOD FOR DETERMINING A BENDING ANGLE OF A SHEET AND THE USE THEREOF FOR THE ANGLE-BENDING OF SHEETS

The present invention relates to a method for determining the bending angle of a sheet which has been bent along a bending line, for example on an angle-bending or folding machine, comprising the steps of generating at least one light beam, using these light beams to project two points or line segments onto a part of the sheet to be checked which lies on one side of the bending line, the beams formed an angle of incidence which is known in advance with the bending line of the sheet, imaging these points or line segments onto receiving means, and determining the distance between the points or line segments which have been projected onto the receiving means.

A measuring method of this type is known, inter alia, from Dutch Publication 8301528. According to the method described in this document, a relative angle is determined, that is to say the difference between the bending angle in a first, generally as yet unbent position of the sheet which is to be deformed and in a second position of the sheet which is to be deformed. Therefore, two measurements are required in order to measure this angles a first reference measurement and a second measurement which gives the change in angle. The angle to be determined in this way is therefore only equivalent to the bending angle if the sheet is flat in the first position. Consequently, it is not possible for example, to determine the bending angle of a workpiece which has already undergone preliminary bending through an angle which is not known. Therefore, the workpiece cannot be bent in a controlled way until a desired bending angle is reached.

Another drawback of this method is that to calculate the bending angle, inter alia the geometric relationships of the bending process are required; consider the geometry of the tool and the point of incidence of the light in the starting situation. Since the measurement is dependent on parameters which are not always known and/or which may vary during the bending, there are errors in the measured angle and these errors can only be corrected with the aid of factors which are dependent on, for example, the thickness of the bent sheet, the material from which the sheet is made and the angle which is to be measured itself. This will be explained in more detail with reference to the figures.

The object of the present invention is to provide a method and device for determining a bending angle which is not dependent on the geometry of the tool. Furthermore, the measurement should not be dependent on a starting position in which preliminary measurements have to be carried out. Consequently, the bending angle can be determined without the workpiece having to be supplied in a configuration which is known in advance. Moreover, it is not necessary for the workpiece to be deformed before the angle can be determined.

According to the present invention, the object is achieved by the fact that the beams lie in two different, parallel detection planes, the distance between which is known, and in that a measurement of the bending angle is determined from the distance between the points which have been projected onto the receiving means, the known angles of incidence of the beams and the known distance between the detection planes. The use of the parallel detection planes according to the invention allows an absolute measurement to be carried out, in which the only parameters required are the distance between the detection planes, the angles of incidence of the beams and the distance between the projected points. This contrasts with the relative measurement according to the prior art.

It is observed that DE 4 312 565 A1 discloses a folding machine for folding a plane workpiece along a folding line, in which by means of a light source a line is projected on each part lying at each side of the folding line of the workpiece. In contrast to the invention the folding angle is derived by interpreting said two lines at both sides of the folding line by means of image processing and a two-dimensional camera.

According to the invention, however, two points or line sections are projected on one part at one side of the folding line and the folding angle is derived from the difference in height from said two points or line sections and the fixed distance between the parallel detection planes.

In a preferred embodiment, the bending line is parallel to the detection planes, and the angles between the two beams and the bending line are equal. This has the advantage that the mathematics required in order to determine a measurement of the bending angle from the said data remains simple.

To enable only one receiving means to be used, it is desirable for the images of the points or line segments which have been projected onto the sheet, during use, always to be sufficiently far apart on the receiving means that the position of both can be determined. In a preferred embodiment, this is achieved by the fact that the points or line segments which are projected onto the sheet are offset with respect to one another in a direction parallel to the bending line.

To simplify the projection of the line segments, it is preferably for the line segments to form part of one line. To obtain the aforementioned offset of the segments, it is therefore necessary in this case for the line to include a "step".

The bending of the sheet which is to be bent does not always have to be identical on both sides of the bending line with respect to a bending plane. Therefore, it is preferable for the measurement according to one of the abovementioned methods to be carried out on both sides of the bending line, for partial bending angles on both sides of the blade to be determined as an intermediate result, and for the bending angle to be determined on the basis of these partial bending angles.

The invention also relates to a method for bending a sheet at a defined angle, comprising the steps of a) lowering an angle-bending blade to a defined height, a supporting sheet being placed on both sides of the displacement plane of the angle-bending blade and this angle-bending being carried out as a function of an angle measurement according to one of the preceding methods, b) completely or partially removing the pressure which the angle-bending blade exerts on the sheet, c) using one of the preceding methods to determine the bending angle of the sheet which has been reached, d) returning to step a) if the desired bending angle has not yet been reached, and e) stopping the bending when the desired bending angle has been reached.

The invention also relates to a method for determining the material deformation in a processing machine, in particular the angle between a surface of the said material and a reference plane, in which one of the abovementioned methods is used.

Moreover, the invention relates to a device for determining a bending angle of a sheet which has been bent along a bending line, comprising at least one light source for generating at least one light beam, in such a way that these beams project two points or line segments onto the sheet to be checked, the beams forming a predetermined angle with the bending line of the sheet, and receiving means for detecting the points or line segments which have been projected onto the sheet, by means of which the distance between these points or line segments can be determined.

According to the present invention, this device is characterized in that there are detection planes in which the beams lie and which are at a known distance from one another, in that there is an optical device which guides the light from the detection planes to the associated receiving means, and in that the processing device comprises a computing unit which calculates the bending angle from the distance between the projected points, the known angles of incidence of the beams and the known distance between the detection planes.

In a preferred embodiments, the bending line is parallel to the detection planes enclosed by the beams, and the angles between the two beams and the bending line are equal.

To enable the measurement to be carried out using one receiving means, it is preferable for the images on the receiving means of the points or line segments which have been projected onto the sheet, during use, always to lie sufficiently far apart for it to be possible to determine the position of both using the said receiving means. This may, for example, be achieved by ensuring that the points or line segments which are projected onto the sheet are offset with respect to one another in a direction parallel to the bending line. When using line segments, it may be advantageous for these segments to form part of one continuous line. To ensure that the abovementioned offset is still obtained, the line can include a "step".

As stated above, for accurate determination of the bending angle it is advantageous to determine partial angles on two sides of the bending line. For this purpose, in one embodiment the device is characterized in that the means required are designed in such a way that measurement can be carried out on both sides of the bending line, that partial bending angles on both sides of the bending line are determined as an intermediate result, and that the computing unit determines the bending angle on the basis of these partial bending angles.

The invention furthermore relates to a device for determining the material deformation in a processing machine, in particular the angle between a surface of the said material and a reference plane. This device is characterized in that one or a combination of the properties of the devices from Claims 10 to 16 is used for this purpose.

Furthermore, the invention relates to an angle-bending blade which can be used in a folding machine. This angle-bending blade comprises a device according to one of the abovementioned devices.

Figure 2:
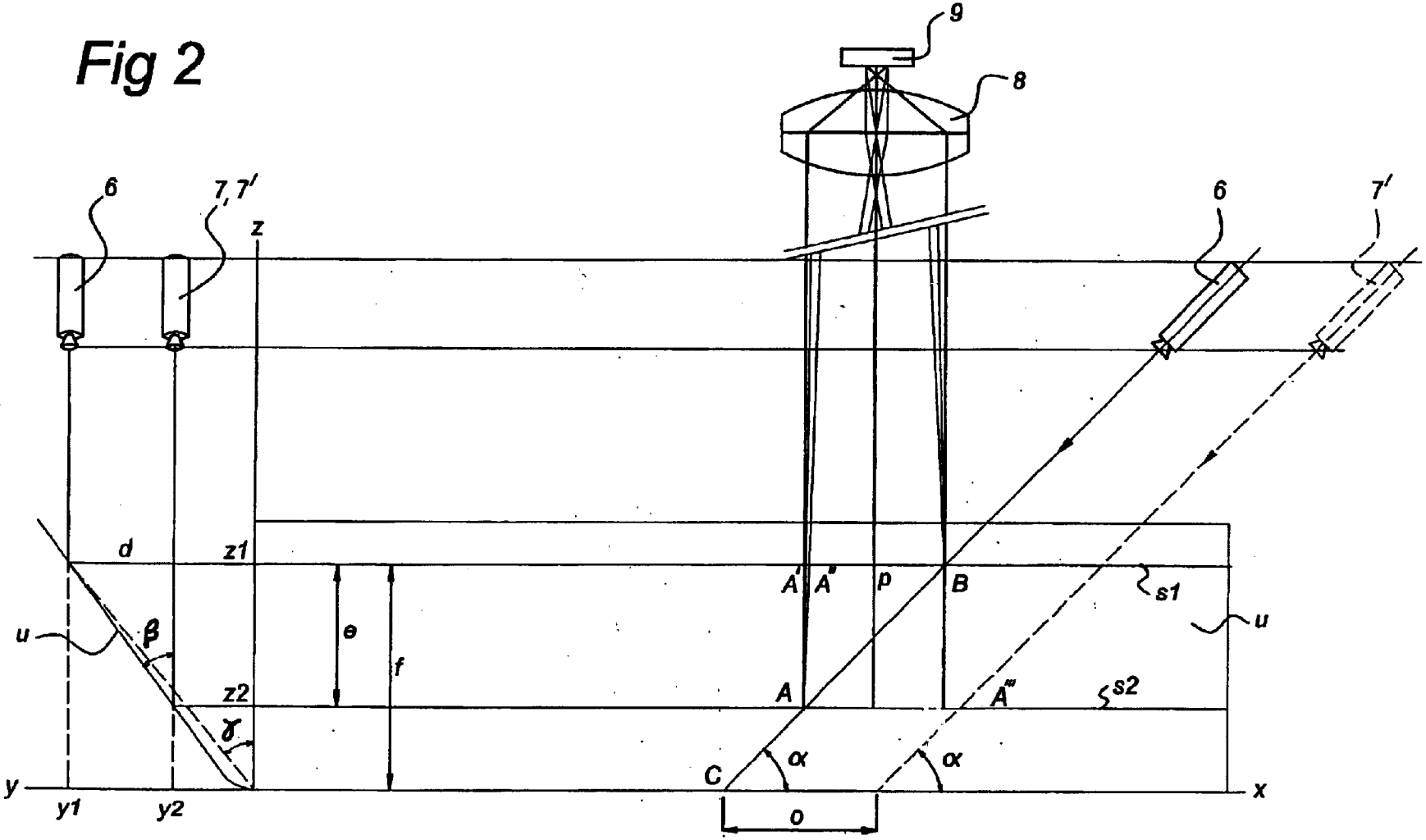

The invention will be discussed in more detail below with reference to the drawings, in which:

FIG. 1 diagrammatically depicts a cross section through a folding machine and an angle-ending blade according to one embodiment of the present invention; and FIG. 2 diagrammatically depicts the way in which the bending angle can be calculated from the known and measured parameters according to one embodiment of the invention.

It should be noted that the device is explained on the basis of an embodiment which, by way of example, is explained for use in a folding machine.

FIG. 1 shows an angle-bending blade or upper blade 1 and a lower blade 2. A sheet 3 is positioned on the lower blade. Since the upper blade has moved part-way into the lower blade, the sheet 3' has been bent into the position of sheet 3 which is shown. The sheet has been bent about the bending line 1 which is perpendicular to the plane of the drawing and is parallel to the bottom edge of the upper blade.

While the upper blade is being moved downwards, the sheet is held in place by the edges 4 of the lower blade. The bending angle is generally defined in a plane which is perpendicular to the bending line. In FIG. 1, a part of the bending angle is denoted by $\beta$. This is the angle between the line m and the direction of movement of the upper blade, denoted by the line n, both lines lying in the plane of the drawing. It should be clear that if the measurement of the bending angle is dependent on the geometry of the tool, the way in which the sheet 3 bears against the edges 4 of the bottom blade and against the point 5 of the upper blade will affect the accuracy of this measurement. Determining precise information about the edges of the two blades 1, 2 is a laborious task. Moreover, these values are susceptible to change as a result of multiple use of the blades 1, 2 and a result of the said blade 1, 2 being compressed on account of the pressure exerted by the sheet. Conversely, the blades 1, 2 can also compress the sheet, which also causes deviations. Furthermore, the contact line between the edge of the lower blade and the sheet is also dependent on the bending angle to be determined. As has been stated, the measurement methods according to the prior art use this information and are therefore relatively inaccurate.

Furthermore, it can be seen in FIG. 1 that even if the contact lines between blades 1, 2 and the sheet 3 are known, the angle $\gamma$ between line o and line n which can be determined in this way is still not the desired angle. This results, inter alia, from the thickness D of the sheet 3 and the fact that the curvature of the sheet in the vicinity of the point of the upper blade 1 is finite. This therefore also represents a source of inaccuracy.

FIG. 2 diagrammatically depicts how an embodiment of the measurement method according to the present invention works. The bending line coincides with the x-axis which is shown on the right-hand side of the z-axis. The y-axis is shown on the left-hand side of the z-axis. The projections of the space onto the yz-plane and the xz-plane are shown in these planes. Therefore, the sheet 4 can be seen in both planes.

The light sources 6 and 7 project their beams onto the sheet 4. A and B represent the points at which the respective beams touch the sheet. If the light sources project line segments, A and B are the points on these segments which intersect the detection planes. The same applies if the light sources were to project a line. In the xz-plane, only light source 6 is visible, since light 7 lies directly behind it. The parallel planes in which the beams lie are indicated in the yz-plane by the respectively y coordinates $y_1$ and $y_2$. The plasma run parallel to the xz-plane and are therefore entirely defined by these y coordinates. The lines $s_1$ and $s_2$ are the intersection lines between the sheet 4 and the respective planes defined by $y_1$ and $y_2$. Due to the distance between these planes, denoted by d in the yz-plane, the respective intersection lines lie at different heights, $z_1$ and $z_2$ respectively.

It can be seen in the yz-plane that the tangent of the bending angle $\beta$ which is to be determined can be determined from the distance d and the difference in height between the intersection lines s1 and s2, denoted by e. It can be seen from the xz-plane that the distance e and the distance p between the points A' and B have a relationship which is dependent on the angle $\alpha$. After all, simple goniometry dictates that $\tan(\alpha)$ is equal to e divided by p. It is therefore clear that by determining the distance p it is possible to determine the bending angle with the aid of the known angle $\alpha$ and the known distance between the detection planes d.

This distance p is determined by imaging the points A and B onto a receiving device 9 by means of a lens 8. This receiving device is preferably a CCD linear array. It is possible to use a linear array since it is known that the points A and B can only run in the detection planes. If the points A and B are projected onto two receiving devices, p is found by determining the respective distances from A and B to an arbitrary reference point. Distance p is then obtained from the difference between these distances.

In this way, however, instead of the desired distance p, the distance between A" and B is determined. However, by suitably selecting the lens system and keeping the distance d between the reference planes small, it is possible to minimize this deviation, or alternatively a correction factor may be employed.

If the sheet 4 is flat, the points A and B will coincide at point C, which may be undesirable under certain circumstances. To prevent this, it is possible, for example, for light 7 to have an offset o in the x-direction. This is diagrammatically indicated by means of the light 7'. In this case, this light 7' still lies in the detection plane $y_2$. The distance between the points A and B is now derived from the distance between A"' and B, corrected for the offset o.

In the yz-plane, it can also be seen that, despite the finite nature of the radius of curvature of the fold in the sheet, the accuracy of the angle measurement is not affected. Methods which, as in the abovementioned prior art use the geometry of the blades will measure the angle $\gamma$ instead of the angle $\beta$. For these methods, it therefore holds that the greater the radius of curvature of the fold, the greater the measurement error.

Because of the simplicity of the measuring method and therefore of the device means this device can be integrated in an upper blade 1. FIG. 1 shows an embodiment of this arrangement. This blade is suitable for measuring partial angles constituting the bending angle $\beta$ on two sides. For this purpose, continuous recesses 10, 11, 12, 13 are formed in the blade. These recesses represent the detection planes, the distance between which is $d_1$ and $d_2$, respectively. In these recesses, it is thus necessary both to create space to allow the light to impinge on the sheet 3 and to guide the reflected, scattered light to the sensor. In the embodiment shown, the light source and the sensor are positioned in the vicinity of the top end 14 of the recesses 10, 11, 12, 13. The embodiment shown in the figure also comprises prisms 15, 16, 17 for guiding the light in the desired way. As a result of the use of the four detection planes, this angle-bending blade can be used to accurately determine the total bending angle.

As a result of all the components of the device being positioned on the upper blade, it is possible for the bending angle to be determined immediately even though the blade has only just been positioned inside the folding machine.

What is claimed is:

1. A method for determining the bending angle of a sheet which has been bent along a bending line, comprising the steps of:

a) generating at least two light beams;

b) using these light beams to project two points or line segments onto a part of the sheet to be checked which lies on one side of the bending line, the beams forming an angle of incidence which is known in advance with the bending line of the sheet;

c) imaging these points or line segments onto receiving means;

d) determining the distance between the points or line segments which have been projected onto the receiving means;

e) choosing two parallel detection planes extending parallel to the bending line and having a predetermined distance (d);

f) orienting the light beams such that they lie in said parallel detection planes and have equal angles of incidence; and g) calculating the bending angle ($\beta$) from the projected distance (p) of the points projected on a sheet to be bent, the known angles ($\alpha$) of incidence of the beams, and the known distance (d) between the detection planes.

2. A method according to claim 1, wherein $\tan \beta = d/p \tan \alpha$.

3. A method according to claim 1, wherein the points or line segments which have been projected onto the sheet are imaged onto the receiving means in such a manner that the images are always sufficiently far apart for it to be possible to determine the position of both images using the receiving means.

4. A method according to claim 1, wherein the points or line segments which are projected onto the sheet are offset with respect to one another in a direction parallel to the bending line.

5. A method according to claim 1, wherein the line segments form part of one continuous line.

6. A method according to claim 1, which is carried out on both sides of the bending line; wherein partial bending angles on both sides of the bending line are determined as an intermediate result; and wherein the bending angle is determined on the basis of these partial bending angles.

7. A method for bending a sheet at a defined angle, which comprises the following steps:

a) lowering an angle-bending blade to a defined height, a supporting sheet being placed on both sides of the displacement plane of the angle-bending blade and this angle-bending being carried out as a function of an angle measurement according to the method of claim 1;

b) completely or partially removing the pressure which the angle-bending blade exerts on the sheet;

c) using the method claim 1 to determine the bending angle of the sheet which has been reached;

d) returning to step a) if the desired bending angle has not yet been reached; and e) stopping the bending when the desired bending angle has been reached.

8. A device for determining a bending angle of a sheet on a folding machine, comprising:

a) at least one light source for generating at least one light beam which is directed onto a support surface for a sheet which is to be bent and, in use, for projecting two points or line segments onto a part of the sheet to be checked which lies on one side of a bending line, said at least one beam forming a predetermined angle of incidence with the bending line of the sheet;

b) receiving means for the detection of the points or line segments which have been projected onto the sheet, which receiving means are connected to a processing device which is able to determine the distance between these points or line segments;

c) means defining two detection planes extending parallel to each other and a bending line of the sheet to be folded and which are at a known distance (d) from one another;

d) the beams being oriented such that they lie in said detection planes and have equal angles of incidence;

e) an optical device which guides the light from the detection planes to the associated receiving means; and f) the processing device comprising a computing unit for calculating the bending angle from the distance between the projected points, the known angles of incidence of the beams and the known distance between the detection planes.

9. A device according to claim 8, wherein images on the receiving means of the points or line segments which have been projected onto the sheet during use, always line sufficiently far apart for it to be possible to determine the position of both images.

10. A device according to claim 8, wherein the points or line segments which are projected onto the sheet are offset with respect to one another in a direction parallel to the bending line.

11. A device according to claim 10, wherein the line segments from part of one continuous line.

12. A device according to claim 8, wherein a) the device is designed in such a way that measurements can be carried out on both sides of the bending line;

b) partial bending angles on both sides of the bending line are determined as an intermediate result; and c) the computing unit determines the bending angle on the basis of these partial bending angles.

13. A device for determining the angle between a surface of material and a reference plane, wherein a device according to claim 8 is used for this purpose.

14. An angle-bending blade for use in a bending device according to claim 8, wherein on at least one side of a center axis this blade comprises two slots which run parallel to one another and to the center axis and form detection planes for the detection of points of light or line segments.

15. An angle-bending blade according to claim 14, wherein the slots follow the shape of the blade and are provided with an optical device for guiding light, which is present in the detection planes, in these slots.

* * * * *